US006360416B1

(12) United States Patent
Stahlecker

(10) Patent No.: US 6,360,416 B1
(45) Date of Patent: Mar. 26, 2002

(54) PROCESS FOR EXCHANGING THE BEARINGS OF A TRAVERSING FIBER GUIDING ROD AND TEXTILE MACHINE ACCOMMDATING SAME

(75) Inventor: Fritz Stahlecker, Bad Ueberkingen (DE)

(73) Assignees: Fritz Stahlecker, Bad Überkingen (DE); Hans Stahlecker, Süssen (DE)

( * ) Notice: Subject to any disclaimer, the term of this patent is extended or adjusted under 35 U.S.C. 154(b) by 0 days.

(21) Appl. No.: 09/396,408

(22) Filed: Sep. 15, 1999

(30) Foreign Application Priority Data

Oct. 26, 1998 (DE) ..... 198 49 233

(51) Int. Cl.[7] ..... B23P 6/00

(52) U.S. Cl. ..... 29/402.08; 29/898.01; 29/898.07

(58) Field of Search ..... 29/402.08, 898.01, 29/898.07; 57/1 R, 400, 406

(56) References Cited

U.S. PATENT DOCUMENTS 3,208,134 A * 9/1965 Krewson, Jr. ..... 29/898.01
3,365,783 A * 1/1968 Foster ..... 29/898.01
4,050,140 A * 9/1977 Newell ..... 29/401 B
4,516,396 A * 5/1985 Stahlecker et al. ..... 57/407
4,847,038 A * 7/1989 Martin ..... 376/260
4,850,091 A * 7/1989 Stadelmann ..... 29/402.08
5,447,795 A 9/1995 Pohn et al.
5,452,504 A * 9/1995 Tatro et al. ..... 29/597
5,499,773 A * 3/1996 Raasch et al. ..... 242/43 R
5,553,367 A * 9/1996 Mahoney ..... 29/402.08
5,592,807 A * 1/1997 Breitenhuber et al. ..... 57/406
5,675,881 A * 10/1997 Stadelmann ..... 29/402.08
6,032,452 A * 3/2000 Zott ..... 57/406
6,067,787 A * 5/2000 Wassenhoven ..... 57/407
6,082,091 A * 7/2000 Schroder ..... 57/407
6,105,355 A * 8/2000 Winzen et al. ..... 57/406

* cited by examiner

*Primary Examiner*—S. Thomas Hughes
*Assistant Examiner*—Essama Omgba
(74) *Attorney, Agent, or Firm*—Crowell & Moring LLP

(57) ABSTRACT

Traversing yarn guiding rods in textile machines producing X-packages are often made of carbon fibers for the purpose of reducing the inertia force. These kinds of traversing yarn guiding rods are prone to wear at their bearing points. For this reason, the bearings, having a distance to one another which corresponds to at least twice, preferably three times the traversing stroke, are collectively replaced from time to time, in such a way that the yarn guide rod is supported at different places than before. The replacement bearings are applied staggered to the old bearing points in such a way that the new bearing points now have a distance to the exposed previous bearing points, which distance corresponds to at least one traverse stroke. This results in the replacement bearings acting with a non-worn part of the fiber guiding rod. The life of the yarn guiding rod is thus significantly increased.

6 Claims, 1 Drawing Sheet

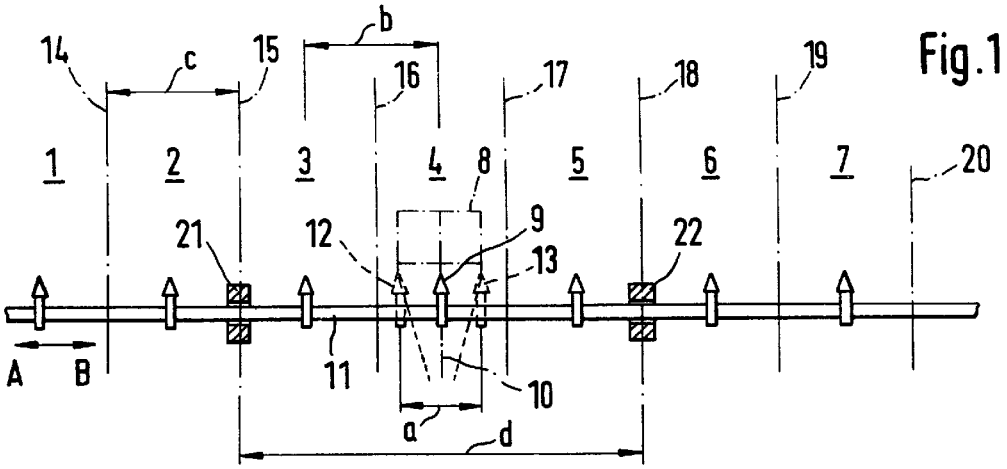
Fig.1
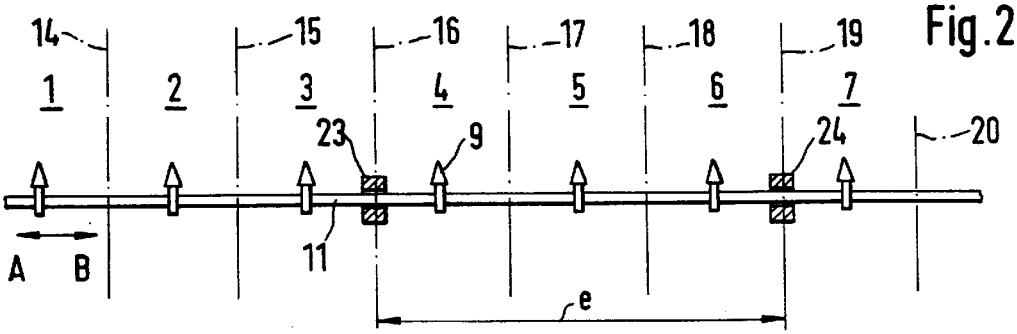
Fig.2
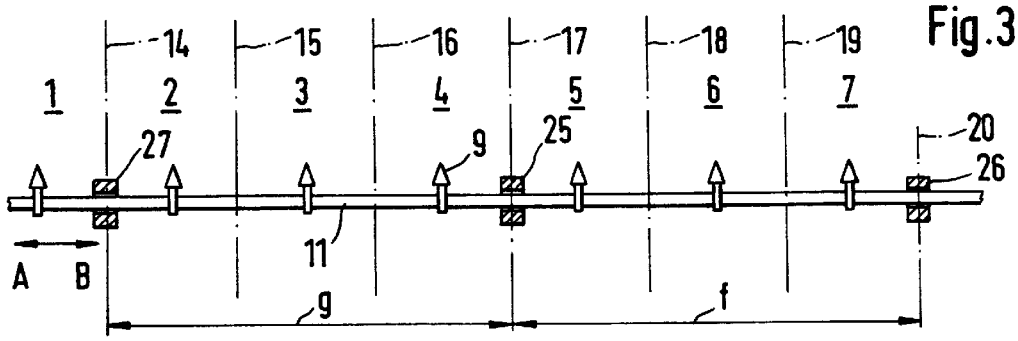
Fig.3
Fig.4
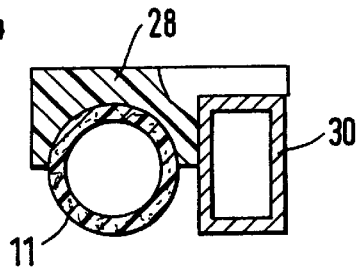
Fig.5
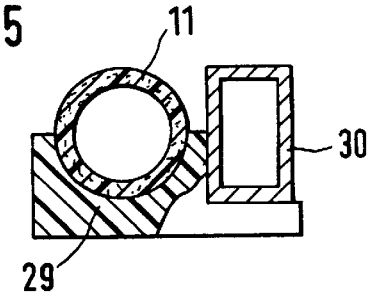

PROCESS FOR EXCHANGING THE BEARINGS OF A TRAVERSING FIBER GUIDING ROD AND TEXTILE MACHINE ACCOMMDATING SAME

BACKGROUND AND SUMMARY OF THE INVENTION

This application claims the priority of German application 198 49 233.2, filed in Germany on Oct. 26, 1998, the disclosure of which is expressly incorporated by reference herein.

The present invention relates to a process for exchanging the bearings of a traversing fiber guiding rod made of carbon fibers or the like in a textile machine producing x-packages (crosswound bobbins), in which machine the distance between two adjacent bearings corresponds to at least twice the traversing stroke.

Traversing yarn guiding rods are accelerated alternately by a traversing drive. In particular when the yarn guide rod has a high mass, for example when it is made of steel, the traversing gear is loaded with a high inertia force. In particular in the case of long textile machines, there are furthermore considerable delays in the return motion of direction. It has already been suggested, for example, in U.S. Pat. No. 5,447,795 that the yarn guiding rod be made of carbon fibers in order to reduce the inertia force. As carbon fiber yarn guiding rods are very inflexible, it is known from machines in practice that the bearing points for the yarn guiding rods are no longer, as was previously the case with steel yarn guiding rods, supported adjacent to each winding head, but rather the distance between the bearing points is increased.

Unfortunately, it has been shown that irregular wear occurs repeatedly in the case of the carbon fiber yarn guiding rods. This is disadvantageous as carbon fiber yarn guiding rods are very expensive. When wear occurs in the yarn guiding rods, replacing the bearings with replacement bearings is of no use, as replacement bearings continue to act with the worn areas of the yarn guiding rods.

It is an object of the present invention to significantly increase the life expectancy of the yarn guiding rods despite the occurring wear of traversing fiber carbon yarn guiding rods.

This object has been achieved in accordance with the present invention in that the bearings are collectively exchanged and replaced by replacement bearings, and that the replacement bearings are applied to new bearing points staggered in such a way to the old bearing points that the new bearing points are at a distance to the now exposed old bearing points, which distance corresponds to at least one traversing stroke.

The present invention is based on the knowledge that when the distance between two adjacent bearings corresponds to at least twice the traversing stroke, a maximum of half a length of the yarn guiding rod can be worn. The replacement bearings are then assembled at a new place at which the yarn guiding rod is not yet worn. For example, the bearings can be exchanged for new replacement bearings in yearly rotation. Such replacement bearings are, for example when they are designed as a plastic sliding bearing, decidedly cost-effective. The replacement bearings are then assembled, staggered, at a chosen distance, which must at least correspond to the traversing stroke. Prepared fixing surfaces can be provided on the textile machine for this purpose. As a result of this staggering, the newly applied replacement bearing acts with a nonworn part of the yarn guiding rod. This mating of material is thus ideal. The previous bearing point now remains free of all bearings. When the next change is due, the bearings move a further length along the rod, which length corresponds to at least one traversing stroke, for example the length of one winding station spacing. This process can be continued until the yarn guiding rod is worn practically all along its length and must be subsequently replaced. As a rule, this process can be applied three times.

Due to the process for exchanging the bearings according to the present invention, the exchange of a traversing yarn guiding rod or of individual parts for new ones is considerably delayed. For example, instead of having to change the yarn guiding rod every year, it can remain for double this time or even three times as long in the textile machine. The new replacement bearings are always applied there, where the yarn guiding rod shows no signs of wear.

In the case of a textile machine producing X-packages, in particular an open-end spinning machine comprising a traversing yarn guiding rod made of carbon fibers, it is purposeful when the bearing points for the replacement bearings to be installed are predetermined. Usually, adjacent to many winding stations or spinning stations, it is possible to affix the necessary sliding bearings or bearing rollers. The affixing points are prepared, even when, for example, only every third bearing point is needed for a bearing. The open-end spinning machine is therefore so designed that the replacement bearings can be installed at any chosen bearing points.

In a further embodiment of the present invention, the bearings are designed as sliding bearings open on one side. Sliding bearings have proven themselves in the case of traversing yarn guiding rods, as in their case no rotating bearing part needs to be additionally accelerated. If the sliding bearings are designed having one side open, a change is quickly and easily carried out without threading. The sliding bearings can be so designed that they vary in their supporting surfaces. For example, one sliding bearing supports only from below and laterally, the other from above, the next one guides from the left side, the one after that from the right side and so on.

The process according to the present invention can be applied advantageously when used textile machines, which have previously operated with yarn guiding rods made of steel and which have short distances between bearings, are modernized by means of re-equipping them with new parts. Firstly, in the case of such a modernization, a larger distance between the bearing points can be provided, and at the same time a carbon fiber yarn guiding rod can be applied, so that subsequently the changing of bearings can be carried out as described above. In a case like this, the process according to the present invention is particularly simple, as—due to the previous short distances between the bearing points—affixing points are already present adjacent to each winding point.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

BRIEF DESCRIPTION OF THE DRAWINGS

These and further objects, features and advantages of the present invention will become more readily apparent from the following detailed description thereof when taken in conjunction with the accompanying drawings wherein:

FIG. 1 is a schematic side view of traversing yarn guiding rod made of carbon fibers, in which the distance between two bearing points corresponds to three winding point spacings, constructed according to a preferred embodiment of the present invention;

FIG. 2 shows the yarn guiding rod of FIG. 1 after the first bearing change;

FIG. 3 shows the yarn guiding rod according to FIG. 1 after a second bearing change;

FIG. 4 is a greatly enlarged sectional view of a bearing point according to the invention, with a sliding bearing open on one side; and FIG. 5 is a diagram similar to FIG. 4, whereby the open-sided sliding bearing is assembled in reverse.

DETAILED DESCRIPTION OF THE DRAWINGS

In FIG. 1, the area of seven winding stations 1 to 7 of an open-end spinning machine are schematically shown. In a real machine, there are approximately 100 such winding stations on each machine side. Each winding station 1 to 7 serves to wind a so-called crosswound bobbin 8, whereby in FIG. 1, such a crosswound bobbin is denoted by a dot-dash line at only one winding station 4.

Traversing yarn guides 9 serve for the winding on of the X-packages 8, one each of said yarn guides 9 being present perwinding station 1 to 7. The thread or yarn 10 denoted by a dot-dash line at the winding station 4 comes from a spinning station (not shown) and is in general delivered at constant speed to the respective crosswound bobbin 8.

A traversing yarn guiding rod 11 serves for the traversing of the yarn guides 9, to which guiding rod 11 the individual yarn guides 9 are affixed. The traverse drive for the traversing yarn guiding rod 11 according to the traversing directions A–B is not shown.

The traverse stroke "a" denoted at the winding station 4 corresponds to the length of the X-packages 8. In this connection, the return points 12 and 13 of the yarn guide 9 are denoted by a dotted line-at the winding station 4. This applies also to all the yarn guides 9 of all the winding stations 1 to 7 as well as to all the further winding stations not shown in FIG. 1. The respective position of the yarn 10 is also denoted by a dotted line at the winding station 4.

The middle point between two winding stations, for example winding stations 3 and 4, defines the winding station spacing "b." This winding station spacing b is naturally somewhat larger than the maximum traverse stroke "a."

The yarn guiding rod 11 is supported there where the yarn guides 9 do not reach during their traversing motion. In FIG. 1 the possible bearing points 14 to 20 are denoted by dot-dash lines. These possible bearing points 14 to 20 do not necessarily need to be disposed in the exact center between two adjacent winding stations 1 to 7. The distance "c" between two possible bearing points 14 to 20 corresponds as a rule to the winding station spacing "b," unless the winding station spacing "b" is somewhat enlarged at the end of a respective machine section by means of intermediate supports.

As already mentioned above, the yarn guiding rod 11 is made of carbon fibers to reduce the inertia force. It is, for example, in FIG. 1 supported by bearings 21 and 22 at the bearing points 15 and 18. The distance "d" of these two adjacent bearings 21 and 22 from one another corresponds therefore to three times the winding station spacing "b." As no longer shown in the section of FIG. 1, after each third winding station, a further bearing is present.

As the carbon fiber yarn guiding rod 11 is less flexible than a standard yarn guiding rod made of steel, the yarn guiding rod 11 does not need to be supported beside each individual winding station 1 to 7, rather, as described above, the increased distance "d" between two adjacent bearings 21 and 22 is sufficient. Important for the present invention is that this distance "d" in minimum is in any case larger than twice the traverse stroke "a."

At the bearings 21 and 22, as well as at the other bearings not shown, irregular wear occurs repeatedly in the carbon fiber yarn guiding rod 11. The bearings 21 and 22 are hereby, as a rule, also subject to wear. If the bearings 21 and 22 and so on are simply replaced by new bearings, it must be taken into consideration that the replacement bearings will act on worn areas of the yarn guiding rod 11 and thus that the yarn guiding rod 11 continues to wear, whereby too much clearance rapidly occurs.

For this reason it is provided, as shown in FIG. 2, that after the bearings 21 and 22 have been removed, the new replacement bearings 23 and 24 are mounted on those places where the traversing yarn guiding rod 11 is not yet worn. This is, for example, the case with the possible bearing points 16 and 19, as shown in FIG. 2. The procedure here is that, for example, all old bearings 21,22 etc. are exchanged yearly for new bearings 23,24 etc. In relation to the now exposed bearing points 15 and 18, the new bearing points 16 and 19 are staggered to the amount of at least one traverse stroke "a" (in FIG. 2 to the right), practically to the amount of one winding point spacing "b." The new bearing points 16 and 19 in the open-end spinning machine have already been prepared beforehand for this purpose, for example by means of the provision of affixing bore holes. The new distance "e" between two adjacent replacement bearings 23 and 24 corresponds hereby to the previous distance "d."

In the case of the replacement bearings 23 and 24, as well as all further replacement bearings, very cheap plastic components are involved. As a result of the staggered arrangement of the bearings, each newly applied replacement bearing 23 and 24 acts on a non-worn part of the traversing yarn guiding rod 11, whereby a good bearing mating arises.

When the next bearing change is due, as shown in FIG. 3, the old bearings 23 and 24 as well as all the other bearings are again collectively changed and replaced by new replacement bearings 25,26 etc. The new replacement bearings 25 and 26 are now located at the prepared bearing points 17 and 20. The new distance "f" between bearings corresponds again to the previous distances between bearings "d" and "e." The old bearing points 16 and 19 are now exposed. This results in the advantage that the newly applied replacement bearings 25 and 26 do not act together with worn parts of the yarn guiding rod 11.

In FIG. 3 a further replacement bearing 27 can be seen to the far left, which has become visible on the drawing surface due to the staggering of the present invention. The distance "g" between the replacement bearing 27 and the adjacent replacement bearing 25 corresponds to the other distance "f."

Due to the exchanging of the bearings according to the present invention as shown in FIGS. 1 to 3, the replacing of a yarn guiding rod 11 or of individual parts of same as a result of wear is considerably delayed. The yarn guiding rod 11 can last for considerably longer than a year, thus avoiding the need for a yearly replacement. The new replacement bearings 23,24 or 25,26 are always applied where the yarn guiding rod 11 is not yet worn. It is important in this process that the open-end spinning machine is so designed beforehand so that the replacement bearings 23 to 26 can be mounted as desired at different bearing points 14 to 20.

In the enlarged drawings in FIGS. 4 and 5, two adjacent sliding bearings 28 and 29, open on one side and made of plastic, are shown. Such open-sided sliding bearings 28 and 29 make it possible to assemble replacement bearings 23 to 26 without having to thread them onto the yarn guiding rod 11. The sliding bearings 28 and 29 can each be applied to a fixing rail 30 or the like.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A process for exchanging bearings in a textile machine which produces X-packages and includes:

a traversing yarn guiding rod which in use carries a plurality of yarn guides operable to guide respective yarns to respective X-packages with axial traversing movements of the yarn guiding rod, and a plurality of bearings disposed at respective bearing points and operably supporting the yarn guiding rod to be slidable axially thereover during the traversing movements of the yarn guiding rod, said bearings being spaced axially of the yarn guiding rod from one another by a distance corresponding to at least twice an in use axial traversing stroke of the yarn guiding rod, said process comprising:

removing the bearings and replacing them with replacement bearings disposed at new replacement bearing points which are axially staggered with respect to the respective previous bearing points in such a way that the new bearing points are at a distance from the previous bearing points corresponding to at least one traversing stroke of the guiding rod.

2. The process according to claim 1, wherein the new bearing points are staggered by the amount of a winding point spacing to the previous bearing points.

3. The process according to claim 2, wherein the traversing yarn guiding rod is made of carbon fibers.

4. The process according to claim 3, wherein the textile machine is an open-end spinning machine.

5. The process according to claim 1, wherein the traversing yarn guiding rod is made of carbon fibers.

6. The process according to claim 1, wherein the textile machine is an open-end spinning machine.

* * * * *